US012723853B1

(12) United States Patent
Chesnut

(10) Patent No.: US 12,723,853 B1
(45) Date of Patent: Sep. 1, 2026

(54) ARROW NOCK ASSEMBLY HAVING VISUAL INDICATION MEMBERS

(71) Applicant: Andrew Chesnut, Indiantown, FL (US)

(72) Inventor: Andrew Chesnut, Indiantown, FL (US)

( * ) Notice: Subject to any disclaimer, the term of this patent is extended or adjusted under 35 U.S.C. 154(b) by 0 days.

(21) Appl. No.: 19/290,830

(22) Filed: Aug. 5, 2025

(51) Int. Cl.
*F42B 6/06* (2006.01)
*F42B 12/38* (2006.01)

(52) U.S. Cl.
CPC ..... *F42B 6/06* (2013.01); *F42B 12/38* (2013.01)

(58) Field of Classification Search
CPC .. F42B 6/04; F42B 6/06; F42B 12/362; F42B 12/38; F42B 12/382; F42B 12/40; F42B 12/42
USPC ..... 473/570, 577, 578
See application file for complete search history.

(56) References Cited

U.S. PATENT DOCUMENTS 3,417,994 A * 12/1968 Rohrbaugh, Jr. ..... F42B 6/04 473/577
3,993,311 A * 11/1976 Johnson ..... F42B 6/04 473/585
4,421,319 A * 12/1983 Murphy ..... F42B 6/04 473/578
4,547,837 A * 10/1985 Bennett ..... F42B 6/06 420/586
5,134,552 A * 7/1992 Call ..... F42B 12/382 362/276
6,123,631 A * 9/2000 Ginder ..... F42B 12/362 473/578
6,364,499 B1 * 4/2002 Jones ..... F21K 2/06 362/802
6,390,642 B1 * 5/2002 Simonton ..... F42B 12/362 362/276
6,736,742 B2 * 5/2004 Price ..... F42B 12/382 473/578
6,764,420 B2 * 7/2004 Cyr ..... F42B 6/06 473/578
7,021,784 B2 * 4/2006 DiCarlo ..... F21V 33/008 362/253
7,211,011 B1 * 5/2007 Sutherland ..... F42B 6/06 473/578
7,862,457 B1 * 1/2011 Urcheck ..... F42B 12/40 473/578
7,909,714 B2 * 3/2011 Cyr ..... F42B 6/06 473/578

(Continued)

*Primary Examiner* — Alexander R Niconovich
(74) *Attorney, Agent, or Firm* — Gulf Coast Intellectual Property Group

(57) ABSTRACT

An arrow nock assembly operably coupled into the shaft of an arrow wherein the present invention is configured to provide a trail of visual indication members that are deposited onto the ground in order to facilitate location of an animal shot with the arrow having the arrow nock assembly of the present invention. The present invention includes a body having a first portion and a second portion integrally formed. The second portion includes a wall member defining an annular shape thereof and has a cavity. A collar member is movably coupled to the second portion of the body providing either coverage or exposure of openings formed in the wall of the second portion. A stem member is integrally formed with the second portion and extends outward therefrom. The stem member includes an interior volume and is configured to receive and store visual indication members.

14 Claims, 5 Drawing Sheets

(56) References Cited

U.S. PATENT DOCUMENTS

| | | | | |
|---|---|---|---|---|
| 8,123,636 | B1 * | 2/2012 | Temprine | F42B 6/06 473/578 |
| 8,216,097 | B2 * | 7/2012 | Nick | F42B 12/385 473/578 |
| 8,342,990 | B1 * | 1/2013 | Price | F42B 12/362 473/570 |
| 8,366,573 | B2 * | 2/2013 | Hunt | A63B 65/02 473/578 |
| 8,540,594 | B2 * | 9/2013 | Chu | F42B 6/06 473/570 |
| 8,696,498 | B1 * | 4/2014 | Andrus | F42B 12/362 473/578 |
| 8,758,177 | B2 * | 6/2014 | Minica | F42B 6/06 473/570 |
| 9,140,527 | B2 * | 9/2015 | Pedersen | F42B 6/02 |
| 9,151,580 | B2 * | 10/2015 | Pedersen | F42B 6/02 |
| 9,279,648 | B2 * | 3/2016 | Marshall, Jr. | F42B 12/382 |
| 9,329,005 | B2 * | 5/2016 | Meier | F42B 6/06 |
| 9,546,851 | B2 * | 1/2017 | Kim | F42B 12/382 |
| 9,677,859 | B1 * | 6/2017 | Kim | F42B 6/06 |
| 9,702,672 | B1 * | 7/2017 | Kim | F42B 6/06 |
| 9,733,051 | B2 * | 8/2017 | Bay | F42B 6/06 |
| 9,989,231 | B2 * | 6/2018 | Mai | F42B 12/382 |
| 10,001,353 | B1 * | 6/2018 | Godsey | F42B 6/06 |
| 10,094,642 | B1 * | 10/2018 | Godsey | F42B 6/06 |
| 10,139,205 | B2 * | 11/2018 | Yehle | F42B 12/42 |
| 10,203,187 | B1 * | 2/2019 | Bay | F42B 6/06 |
| 10,254,095 | B1 * | 4/2019 | Wang | F21V 23/04 |
| 10,704,873 | B1 * | 7/2020 | Minica | F42B 6/06 |
| 10,794,672 | B2 * | 10/2020 | Oman | F21V 23/0414 |
| 10,859,353 | B1 * | 12/2020 | Minica | F42B 6/06 |
| 11,512,933 | B2 * | 11/2022 | Kirsch | F21V 33/008 |
| 11,598,614 | B1 * | 3/2023 | Godsey | F42B 6/06 |

* cited by examiner

ARROW NOCK ASSEMBLY HAVING VISUAL INDICATION MEMBERS

FIELD OF THE INVENTION

The present invention relates generally to bow hunting accessories, more specifically but not by way of limitation, a hunting arrow having a nock assembly that is configured to store and dispense visual indication members that dispense subsequent the arrow being shot into a desired animal target to facilitate location of the animal target.

BACKGROUND

Bow hunting is a time-honored practice that demands a high degree of skill, patience, and ethical responsibility from hunters. Unlike rifle hunting, which offers greater range and force, bow hunting requires a closer approach, precise aim, and calm execution under variable environmental conditions. Among the many challenges bow hunters face, low light conditions during dawn or dusk the times when deer are most active present some of the most difficult circumstances. These conditions, when paired with the possibility of a non-lethal shot, often result in the complex and emotionally taxing task of tracking a wounded animal. Traditional tracking methods have their limitations, and the development of an arrow configured to deposit visual indication materials could provide significant benefits to hunters seeking to locate their quarry quickly and ethically.

Many game animals, including deer, are crepuscular, meaning they are most active during the early morning and late evening hours. These periods coincide with low light conditions that diminish visibility and complicate a hunter's ability to clearly identify targets and aim with precision. Shadows can distort perception, making it harder to determine the exact position of a deer's vital organs. Additionally, low light may hinder the hunter's ability to see arrow flight and assess whether a shot resulted in a clean kill. Even with modern optics, such as illuminated sight pins and rangefinders, a hunter's ability to make an ethical shot under low light is significantly reduced. A clean, quick kill is the goal of every responsible hunter. However, in low visibility, even minor misjudgments in aim or angle can lead to a non-fatal shot that wounds the animal. This situation introduces a host of challenges, both practical and ethical, in the aftermath.

When a shot fails to immediately drop a deer, the hunter is obligated to make every reasonable effort to locate and recover the animal. Tracking a wounded deer requires attention to subtle signs left behind during the animal's retreat. The most common indicator is a blood trail. However, depending on the nature and placement of the wound, blood trails may be sparse or nearly invisible. Factors such as thick underbrush, rain, or the deer's movement pattern can make blood even harder to detect. Hunters typically rely on a combination of methods to track a wounded animal. These include tactics such as blood trail analysis wherein the hunter interprets the color, quantity, and location of blood to estimate wound severity and direction of travel. Another technique is broken vegetation analysis wherein the hunter makes note of disturbed foliage, trampled grass, or snapped branches. Additionally, hunters can use binoculars or mental notes to estimate last known direction and behavior in combination with finding tufts of hair. Despite these techniques, success is not guaranteed. Recovery can take hours, or the trail may be lost entirely. A wounded animal left unrecovered can suffer unnecessarily and may go to waste, violating the ethical standards of responsible hunting.

To address these challenges, the development of an arrow designed to deploy visual indication materials could significantly enhance recovery efforts. Such arrows could be engineered to contain traceable substances such as brightly colored, biodegradable dyes or UV-reactive compounds that are released upon impact. These materials would create a visible trail along the deer's path, especially in low light, where blood may be difficult to detect. Incorporating these visual tracking aids into the arrow shaft or broadhead would not interfere with arrow flight and could be activated through pressure or temperature changes upon impact. The visual indicators would remain detectable over time, resisting environmental degradation from rain or ground cover. Some advanced configurations might include microcapsules or powder that adheres to the deer's coat and marks vegetation, further enhancing visibility.

Bow hunting in low light conditions poses substantial challenges that test both the skill and ethics of hunters. The difficulty in executing a clean kill shot is compounded by the complexities of tracking a wounded animal when visual clues like blood trails are minimal. Conventional tracking methods, while useful, often fall short in difficult environments. The introduction of arrows equipped with visual indication materials represents a promising advancement that could improve hunting outcomes and uphold the ethical standards of wildlife harvesting. As technology continues to evolve, hunters stand to benefit from innovations that enhance both their effectiveness and their responsibility in the field.

Accordingly, there is a need for a hunting arrow having a nock assembly that is configured to store and dispense visual indication members that dispense subsequent the arrow being shot into a desired animal target to facilitate location of the animal target

SUMMARY OF THE INVENTION

It is the object of the present invention to provide a hunting arrow having a nock assembly configured to assist a hunter locate an animal target subsequent shooting thereof wherein the nock assembly of the present invention includes a body having a first portion and a second portion.

Another object of the present invention is to provide a nock assembly for an arrow that is operable to assist a user in locating an animal target wherein the second portion of the nock assembly includes a cavity member.

A further object of the present invention is to provide a hunting arrow having a nock assembly configured to assist a hunter locate an animal target subsequent shooting thereof wherein the second portion has at least one opening formed therein providing access to the cavity member.

Yet a further object of the present invention is to provide a nock assembly for an arrow that is operable to assist a user in locating an animal target wherein the second portion includes a collar member operably coupled thereto that is movable between a first position and a second position.

Still another object of the present invention is to provide a hunting arrow having a nock assembly configured to assist a hunter locate an animal target subsequent shooting thereof that further includes a stem member integrally formed with the second portion of the nock assembly.

An additional object of the present invention is to provide a nock assembly for an arrow that is operable to assist a user in locating an animal target wherein the stem member has an interior volume having a plunger member and a spring member operably disposed therein.

Yet a further object of the present invention is to provide a hunting arrow having a nock assembly configured to assist a hunter locate an animal target subsequent shooting thereof wherein the present invention further includes a plurality of visual indication members releasably stored in the interior volume of the stem member.

To the accomplishment of the above and related objects the present invention may be embodied in the form illustrated in the accompanying drawings. Attention is called to the fact that the drawings are illustrative only. Variations are contemplated as being a part of the present invention, limited only by the scope of the claims.

BRIEF DESCRIPTION OF THE DRAWINGS

A more complete understanding of the present invention may be had by reference to the following Detailed Description and appended claims when taken in conjunction with the accompanying Drawings wherein:

DETAILED DESCRIPTION

Figure 1:
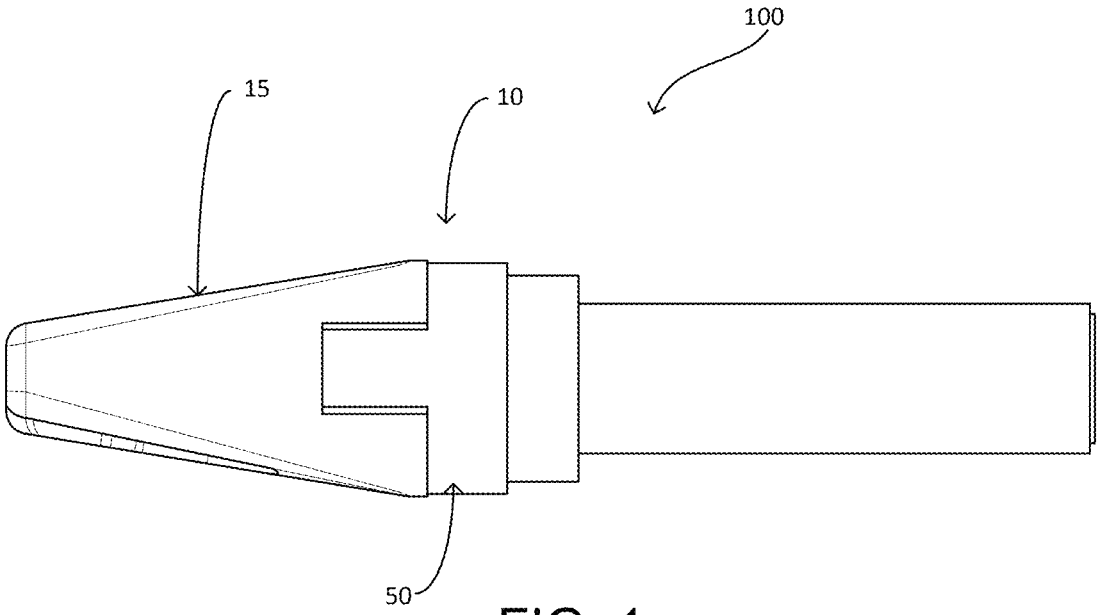
FIG. 1 is a side view of the nock assembly of the present invention with the collar member in its first position.

Referring now to the drawings submitted herewith, wherein various elements depicted therein are not necessarily drawn to scale and wherein through the views and figures like elements are referenced with identical reference numerals, there is illustrated an arrow nock assembly 100 constructed according to the principles of the present invention.

An embodiment of the present invention is discussed herein with reference to the figures submitted herewith. Those skilled in the art will understand that the detailed description herein with respect to these figures is for explanatory purposes and that it is contemplated within the scope of the present invention that alternative embodiments are plausible. By way of example but not by way of limitation, those having skill in the art in light of the present teachings of the present invention will recognize a plurality of alternate and suitable approaches dependent upon the needs of the particular application to implement the functionality of any given detail described herein, beyond that of the particular implementation choices in the embodiment described herein. Various modifications and embodiments are within the scope of the present invention.

It is to be further understood that the present invention is not limited to the particular methodology, materials, uses and applications described herein, as these may vary. Furthermore, it is also to be understood that the terminology used herein is used for the purpose of describing particular embodiments only, and is not intended to limit the scope of the present invention. It must be noted that as used herein and in the claims, the singular forms "a", "an" and "the" include the plural reference unless the context clearly dictates otherwise. Thus, for example, a reference to "an element" is a reference to one or more elements and includes equivalents thereof known to those skilled in the art. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

References to "one embodiment", "an embodiment", "exemplary embodiments", and the like may indicate that the embodiment(s) of the invention so described may include a particular feature, structure or characteristic, but not every embodiment necessarily includes the particular feature, structure or characteristic.

Referring in particular to the Figures submitted herewith, the arrow nock assembly 100 is configured to be operably coupled to a conventional arrow shaft (not illustrated herein) utilizing suitable durable techniques. The arrow nock assembly 100 is manufactured from a durable rigid material such as but not limited to metal or plastic. The arrow nock assembly 100 includes a body 10 wherein the body 10 includes a first portion 15 and a second portion 25. The first portion 15 and second portion 25 are integrally formed utilizing suitable techniques. The first portion 15 is shaped similarly to conventional arrow nock assemblies wherein the first portion 15 includes opposing wing members 16, 17 that form a notch 18 wherein the notch 18 is sized to receive a bowstring therein. The first portion 15 is tapered outward towards the lower perimeter edge 19.

The second portion 25 is contiguous with the first portion 15 wherein the second portion 25 has a diameter that is less than the diameter of the first portion 15 proximate lower perimeter edge 19. The second portion 25 is axially aligned with the first portion 15 extending outward therefrom. The second portion 25 is annular in shape having wall member 26 wherein the wall member 26 defines cavity 30. The wall member 26 includes opening 32 formed therein wherein the opening 32 provides access to the cavity 30. In a preferred embodiment of the present invention, the second portion 32 has a first opening 33 and a second opening 34 that are formed in the wall member 26 being diametrically opposite each other. The first opening 33 and second opening 34 are oval in shape in a preferred embodiment and are present to permit the ejection of the visual indication members 40 as is further discussed herein. While a preferred embodiment is illustrated herein, it is contemplated within the scope of the present invention that the second portion 25 could have as few as one opening or a plurality of openings to achieve the desired objective discussed herein of facilitating ejection of the visual indication members 40. Alterative embodiments of the openings would be based on parameters such as but not limited to size and shape of the visual indication members 40, as well as type of material of the visual indication member 40.

Figure 2:
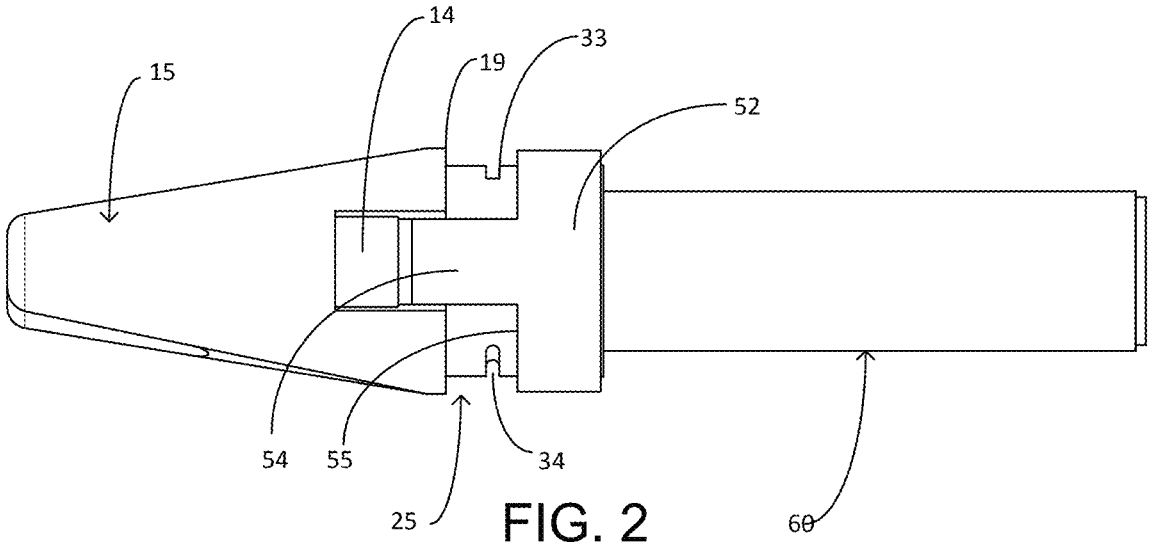
FIG. 2 is a side view of the nock assembly of the present invention with the collar member in its second position.
Figure 3:
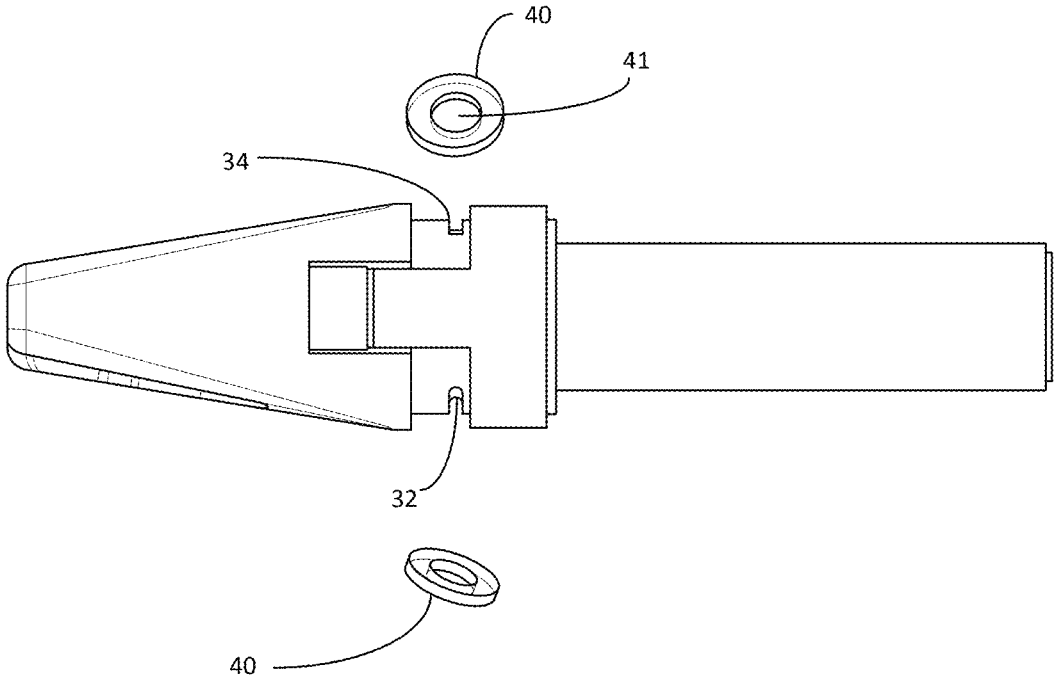
FIG. 3 is a side view of the nock assembly of the present invention with the collar member in its second position dispensing visual indication members.
Figure 4:
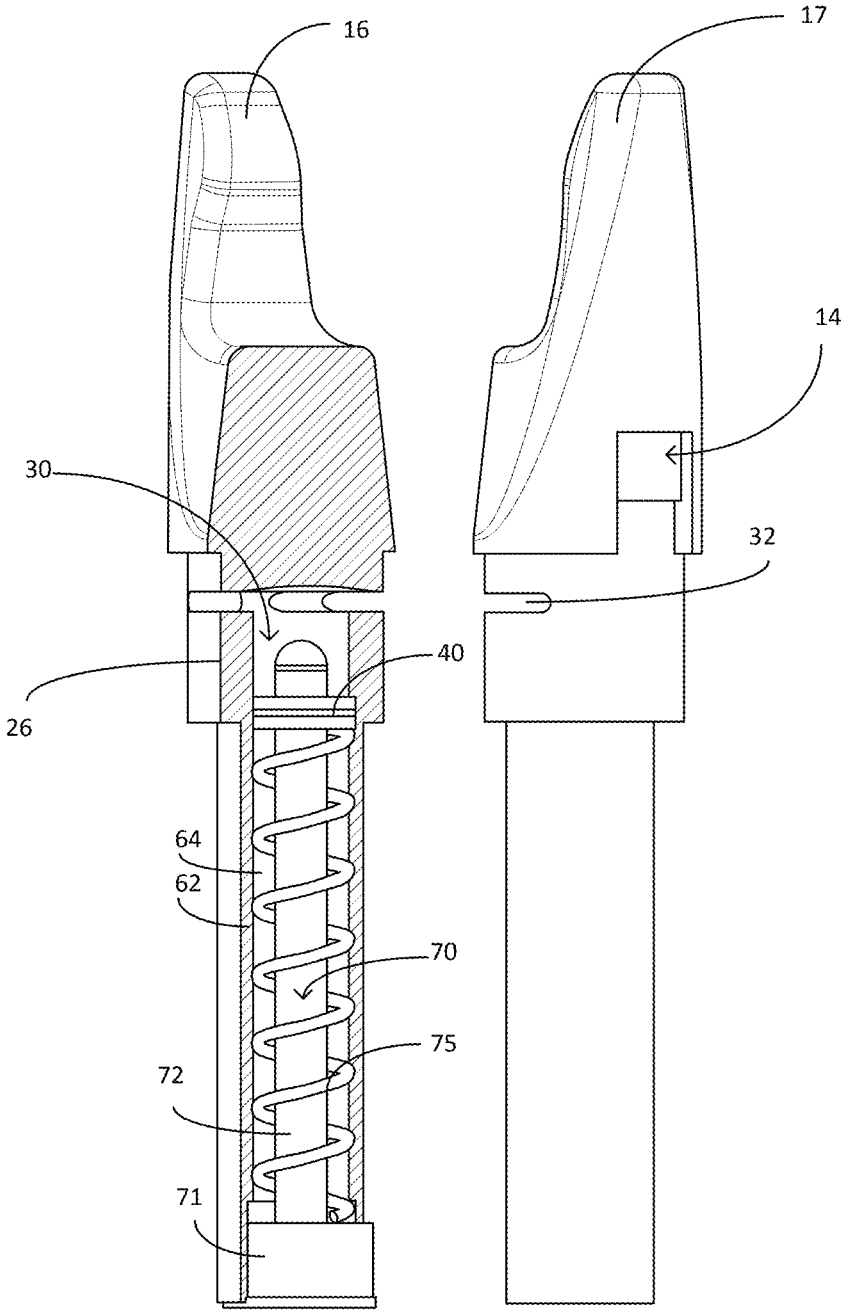
FIG. 4 is a cross-sectional of the nock assembly of the present invention.
Figure 5:
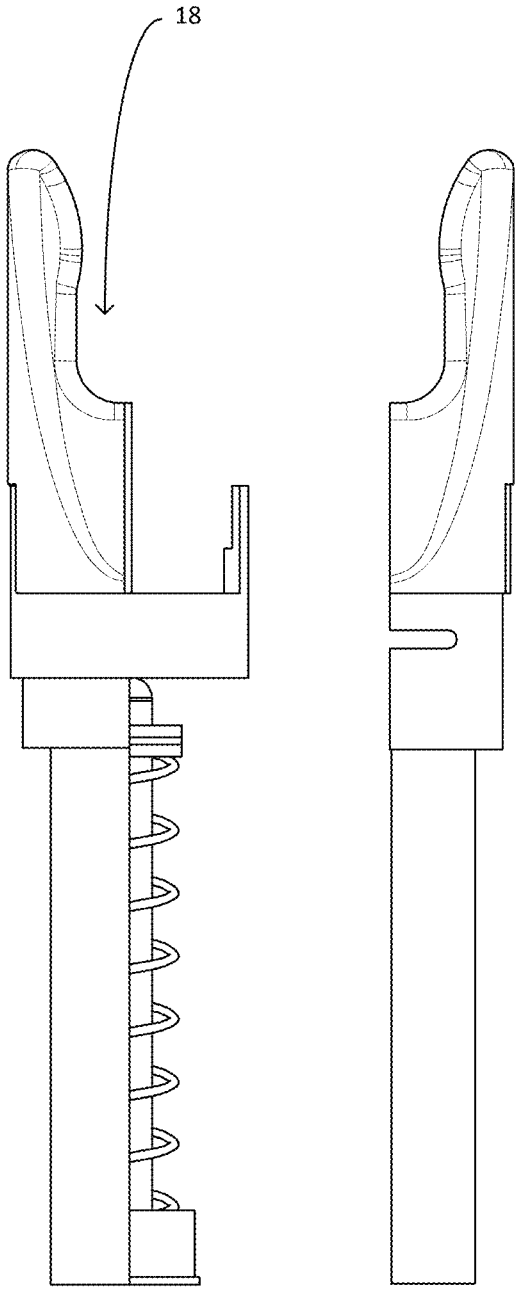
FIG. 5 is a side cross-sectional of the nock assembly of the present invention.

Surroundably mounted to the second portion 25 of the body 10 is the collar member 50. The collar member 50 is movably coupled to the second portion 25 wherein the collar member 50 is movable between a first position and a second position. The collar member 50 in its first position, illustrated herein in FIG. 1, covers the first opening 33 and second opening 34 inhibiting ejection of the visual indication members 40. In its second position, as is illustrated herein in FIG. 2, the collar member 50 has traversed away from the first portion 15 so as to expose the first opening 33 and second opening 34 permitting ejection of the visual indication members 40. The collar member 50 includes a base segment 52 that is annular in shape being circumferentially disposed about the outer surface of the second portion 25. Integrally formed with the base segment 52 are tab members 54 wherein the tab members 54 extend outward from the upper perimeter edge 55 of the base segment 52 and are perpendicular therewith. The tab members 54 are diametrically opposed on the base segment 52 and are configured to frictionally engage with receiving notch 15 formed in the first portion 15 of the body 10. While in a preferred embodiment of the present invention the collar member 50 includes two tab members 54 (only one illustrated herein), it is contemplated within the scope of the present invention that the collar member 50 could utilize one or more than two tab members 54 to operably couple to the receiving notches 14. The tab members 54 are frictionally coupled to the receiving notches 14 so as to permit movement of the collar member 50 to its second position ensuing impact of an arrow into a target having the arrow nock assembly 100. The force absorbed by the arrow during impact of the arrow having the arrow nock assembly 100 into a target is greater than the frictional force maintaining the collar member 50 in its first position. While a preferred embodiment of the collar member 50 has been illustrated and discussed herein, it is contemplated within the scope of the present invention that the collar member 50 could be constructed in alternate manners employing alternate techniques to provide the desired functionality of the collar member 50 as is discussed herein.

Contiguously formed with the second portion 25 is the stem member 60. Stem member 60 extends outward from the second portion 25 being axially aligned therewith. The stem member 60 is cylindrical in shape having outer wall 62 forming interior volume 64 wherein interior volume 64 is operably coupled with cavity 30. The stem member 60 is configured to be inserted into an end of an arrow shaft. The stem member 60, particularly the interior volume 64 thereof, is configured to provide receipt and storage of the visual indication members 40. Disposed within the interior volume 64 is a plunger member 70 and spring member 75. Plunger member 70 includes head portion 71 and shaft portion 72 wherein the shaft portion 72 has a diameter that facilitates being operably inserted into the aperture 41 of the visual indication members 40. The head portion 71 is releasably secured to the stem member 60 employing techniques such as but not limited to threads in order to provide changing of the plunger member 70 and/or spring member 75. The visual indication members 40 are circumferentially mounted to the shaft member 71 wherein as the user loads more visual indication members 40 into the first opening 33 or second opening 34, the spring member 75 is compressed towards the head portion 71. The interior volume 64 is substantially filled with visual indication members 40 and subsequent placement thereof, the collar member 50 is moved to its first position so as to inhibit ejection of the visual indication members 40. Ensuing the collar member 50 being moved to its second position, the compression of the spring member 75 forces the visual indication members 40 towards the first opening 33 and second opening 34 wherein the visual indication members 40 are ejected therefrom. While a preferred embodiment of the plunger member 70 and spring member 75 have been illustrated and discussed herein, it is contemplated within the scope of the present invention that the visual indication members 40 could be stored within the interior volume 64 and ejected from the first opening 33 and second opening 34 utilizing alternate types of movement members depending upon the construction and type of material of the visual indication members 40. Furthermore, it is contemplated within the preferred embodiment of the present invention that the force from the spring member 75 facilitates a measured ejection of the visual indication members 40 so as to ensure avoidance of a rapid ejection of the visual indication members 40 in order to provide an improved trail leading to location of an animal target shot with an arrow having the arrow nock assembly 100.

The visual indication members 40 are planar in manner being disc shaped having a central aperture 41. The central aperture 41 is sized so as to accommodate the shaft 72 therethrough. The visual indication members 40 are manufactured from a material that enhances the ability for a user to see a deposited visual indication member 40 in an area such as but not limited to heavy foliage. In a preferred embodiment of the present invention, the visual indication members 40 are manufactured from a biodegradable material and are luminescent. By way of example but not limitation, the visual indication members 40 could employ phosphorescent, fluorescent or bioluminescent materials embedded into or coated onto the visual indication members 40 to facilitate the enhanced visibility thereof. While a preferred embodiment of the visual indication members 40 is illustrated and discussed herein, it is contemplated within the scope of the present invention that the visual indication members 40 could be constructed in numerous alternate manners in order to achieve the desired objective as discussed herein.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. An arrow nock assembly configured to be operably coupled to an arrow wherein the arrow nock assembly comprises:

a body, said body having a first portion and a second portion, said first portion and said second portion of said body being integrally formed, said first portion of said body having opposing wing members forming a notch for receipt of a bowstring therein, said second portion having a diameter that is less than a diameter of said first portion, said second portion being annular in shape having an exterior wall, said exterior wall of said second portion defining a cavity, said exterior wall having at least one opening formed therein;

a collar member, said collar member being operably coupled to said second portion of said body, said collar member being movable between a first position and a second position wherein in said first position of said collar member a portion of said collar member provides coverage of said at least one opening formed in said exterior wall of said second portion of said body;

a stem member, said stem member being contiguously formed with said second portion of said body extending outward therefrom, said stem member having an outer wall defining an interior volume; and at least one visual indication member, said at least one visual indication member having a planar disc shaped body manufactured from a luminescent material, said at least one visual indication member being disposed in said interior volume of said stem member, said at least one visual indication member configured to be ejected from said at least one opening of said exterior wall of said second portion of said body.

2. The arrow nock assembly configured to be operably coupled to an arrow as recited in claim 1, wherein in said second position, said collar member is removed from covering said at least one opening in said exterior wall of said second portion of said body.

3. The arrow nock assembly configured to be operably coupled to an arrow as recited in claim 2, wherein said at least one visual indication member is operable to be ejected from said at least one opening when said collar member is in said second position.

4. The arrow nock assembly configured to be operably coupled to an arrow as recited in claim 3, wherein said stem member further includes a movement member disposed in said interior volume of said stem member, said movement member configured to facilitate ejection of said at least one visual indication member when said collar member is in said second position.

5. The arrow nock assembly configured to be operably coupled to an arrow as recited in claim 4, wherein said collar member includes a base segment being annular in shape, said base segment having at least one tab member extending outward therefrom.

6. The arrow nock assembly configured to be operably coupled to an arrow as recited in claim 5, wherein said at least one tab member is configured to frictionally engage said first portion of said body in said first position of said collar member.

7. The arrow nock assembly configured to be operably coupled to an arrow as recited in claim 6, wherein said first portion of said body includes at least one receiving notch, said at least one receiving notch configured to operably couple with said at least one tab member of said collar member.

8. An arrow nock assembly configured to be operably coupled to an arrow and provide a deposit of a visible material ensuing contact with an animal target wherein the arrow nock assembly comprises:

a body, said body having a first portion and a second portion, said first portion and said second portion of said body being integrally formed, said first portion of said body having opposing wing members forming a notch for receipt of a bowstring therein, said opposing wing members having an exterior surface, said second portion having a diameter that is less than a diameter of said first portion, said second portion being annular in shape having an exterior wall, said exterior wall of said second portion defining a cavity, said exterior wall having a first opening and a second opening formed therein;

a collar member, said collar member being operably coupled to said second portion of said body, said collar member being movable between a first position and a second position wherein in said first position of said collar member a portion of said collar member provides coverage of said first opening and said second opening formed in said exterior wall of said second portion of said body, said collar member having a base segment, said base segment being annular in shape and circumferentially disposed to said second portion of said body, said base segment having at least one tab member integrally formed therewith, said at least one tab member extending outward towards said first portion of said body;

a stem member, said stem member being contiguously formed with said second portion of said body extending outward therefrom, said stem member having an outer wall defining an interior volume, said interior volume having a plunger member disposed therein, said plunger member having a spring member operably coupled thereto; and a plurality of visual indication members, said plurality of visual indication members having a planar disc shaped body manufactured from a luminescent material, said visual indication members being disposed in said interior volume of said stem member, said plurality of visual indication members configured to be ejected from said first opening and said second opening when said collar member is in said second position.

9. The arrow nock assembly configured to be operably coupled to an arrow and provide a deposit of a visible material ensuing contact with an animal target as recited in claim 8, wherein said plurality of visual indication members are planar in manner and disc shaped, said plurality of visual indication members having a central aperture.

10. The arrow nock assembly configured to be operably coupled to an arrow and provide a deposit of a visible material ensuing contact with an animal target as recited in claim 9, wherein said plurality of visual indication members utilize said central aperture to operably couple to a shaft member of said plunger member, said plurality of visual indication members being arranged in a stacked formation in the interior volume of said stem member.

11. The arrow nock assembly configured to be operably coupled to an arrow and provide a deposit of a visible material ensuing contact with an animal target as recited in claim 10, wherein said collar member is moved to said second position subsequent the arrow impacting an animal target.

12. The arrow nock assembly configured to be operably coupled to an arrow and provide a deposit of a visible material ensuing contact with an animal target as recited in claim 11, wherein said at least one tab member of said collar member is operably coupled with a receiving notch formed in the exterior surface of said opposing wing members of said first portion of said body, said at least one tab member being frictionally engaged with said receiving notch.

13. The arrow nock assembly configured to be operably coupled to an arrow and provide a deposit of a visible material ensuing contact with an animal target as recited in claim 12, wherein said spring member facilitates ejection of said plurality of visual indication members ensuing said collar member being moved to said second position.

14. The arrow nock assembly configured to be operably coupled to an arrow and provide a deposit of a visible material ensuing contact with an animal target as recited in claim 13, wherein said plurality of visual indication members utilize at least one of the following for visibility: fluorescent, phosphorescence or bioluminescent.

* * * * *